US009890958B2

(12) United States Patent
Duong

(10) Patent No.: US 9,890,958 B2
(45) Date of Patent: Feb. 13, 2018

(54) REMOVABLE ENCLOSURE FOR RANGE TOPS

(71) Applicant: Quoc-Vu Duong, Toronto (CA)

(72) Inventor: Quoc-Vu Duong, Toronto (CA)

( * ) Notice: Subject to any disclaimer, the term of this patent is extended or adjusted under 35 U.S.C. 154(b) by 172 days.

(21) Appl. No.: 14/997,869

(22) Filed: Jan. 18, 2016

(65) Prior Publication Data

US 2017/0205081 A1 Jul. 20, 2017

(51) Int. Cl.

| | |
|---|---|
| ***F24C 15/36*** | (2006.01) |
| ***F24C 15/20*** | (2006.01) |
| ***F24C 15/28*** | (2006.01) |

(52) U.S. Cl.

CPC ..... *F24C 15/2042* (2013.01); *F24C 15/2092* (2013.01); *F24C 15/28* (2013.01); *F24C 15/36* (2013.01)

(58) Field of Classification Search

CPC ..... F24C 15/36; F24C 15/28; F24C 15/2042; F24C 15/2092; F24C 3/126; F24C 3/122; A47J 37/01

USPC ..... 126/299 C, 214 D, 273 R, 299 R, 19 R

See application file for complete search history.

(56) References Cited

U.S. PATENT DOCUMENTS 913,465 A * 2/1909 Brouillet ..... F24C 15/2092 126/299 D
931,312 A * 8/1909 Kahn ..... F24C 3/027 126/18
996,554 A * 6/1911 Baldwin et al. ..... D06F 1/06 126/299 D
1,546,717 A * 7/1925 Chilingirian ..... F24C 15/2042 126/37 R
1,735,806 A * 11/1929 Struble ..... F24C 15/36 126/299 R
1,954,257 A * 4/1934 Nessel ..... F24C 15/20 126/299 C
2,081,640 A * 5/1937 Petersen ..... F24C 15/2042 126/299 R
2,478,253 A * 8/1949 Doner ..... A47J 37/041 126/19 R
2,568,276 A * 9/1951 Eggleston ..... F24C 15/36 126/1 R (Continued)

FOREIGN PATENT DOCUMENTS

CA 1122869 A * 5/1982 ..... A47J 37/101
EP 0251974 A2 * 1/1988 ..... F24C 15/36

(Continued)

*Primary Examiner* — Gregory Huson
*Assistant Examiner* — Daniel E Namay
(74) *Attorney, Agent, or Firm* — Elias Borges

(57) ABSTRACT

An enclosure for a range hood. The enclosure has side curtains depending from the sides of the range hood and a front curtain depending from the front of the range hood, all of which extend downward to the range. A first horizontal row of permanent magnets is formed at a lower edge of the front curtain, the front curtain being coupled to the front side of the range hood by a T shaped member having a hook portion for attaching to the front side of the range hood and a second horizontal row of permanent magnets oriented away from the range hood. The two horizontal rows of magnets are configured to couple together to support the front curtain in an elevated position. The curtains of the enclosure are configured to fully enclose the range and range hood.

5 Claims, 5 Drawing Sheets

(56) References Cited

U.S. PATENT DOCUMENTS

| | | | | | |
|---|---|---|---|---|---|
| 2,887,154 | A * | 5/1959 | Morningstar | A47G 5/00 | 126/299 C |
| 4,085,736 | A * | 4/1978 | Kuechler | B01D 45/16 | 126/299 D |
| 4,155,343 | A * | 5/1979 | Hartman | F24C 15/36 | 126/211 |
| 4,422,441 | A * | 12/1983 | Schoepe | F24C 15/12 | 126/299 C |
| 4,467,781 | A * | 8/1984 | Campbell | F24C 15/36 | 126/201 |
| 5,967,136 | A * | 10/1999 | Gray | F24C 15/2042 | 126/299 C |
| 6,371,105 | B1 * | 4/2002 | Merritt | F24C 15/12 | 126/211 |
| 6,526,963 | B2 * | 3/2003 | Hoshowski | F24C 3/124 | 126/42 |
| 8,544,459 | B2 * | 10/2013 | Rees, Jr. | A47J 37/0763 | 126/25 A |
| 2004/0173201 | A1 * | 9/2004 | Haemerle | F24C 15/12 | 126/299 C |
| 2011/0028079 | A1 * | 2/2011 | Dieter | F24C 15/2028 | 454/193 |
| 2015/0338107 | A1 * | 11/2015 | Huang | F24C 15/2042 | 126/299 D |

FOREIGN PATENT DOCUMENTS

| | | | | |
|---|---|---|---|---|
| GB | 361688 | A * | 11/1931 | F24C 15/2042 |
| JP | 61076830 | A * | 4/1986 | F24C 15/12 |
| JP | 2004108753 | A * | 4/2004 | F24C 15/2092 |

* cited by examiner

REMOVABLE ENCLOSURE FOR RANGE TOPS

CROSS REFERENCE TO RELATED APPLICATION

This application claims priority from U.S. provisional application No. 62/119,300 filed Feb. 28, 2015, the entirety of which is incorporated herein by reference.

FIELD OF THE INVENTION

The invention relates generally to enclosures for enclosing the space between a range top and a range hood.

BACKGROUND OF THE INVENTION

Cooking on range tops often involves the creation of smoke and fumes resulting from the cooking process. Range hoods are often provided above range tops to evacuate as much of the smoke and fumes as possible; however, they are completely effective in dealing with the volume of smoke and fumes which are often produced. Therefore, stove enclosures (or range enclosures) are occasionally provided for containing the smoke and fumes. While these enclosures are effective, they are often complicated to assemble and cumbersome to use. An improved enclosure for enclosing the space between a range top and range hood would therefore be useful.

SUMMARY OF THE INVENTION

In accordance with one aspect of the present invention, there is provided an enclosure for a range having opposite right and left sides, a front side and a back side, the range being positioned directly below a range hood having opposite right and left sides, a front side and a back side. The removable enclosure includes opposite right and left curtains depending from the right and left sides of the range hood, the right curtain extending downward to a point just below the right side of the range, the left curtain extending downward to a point just below the left side of the range. The enclosure further includes a front curtain depending from the front side of the range hood and extending downward to a point just below the front side of the range, a first horizontal row of permanent magnets formed as a lower edge of the front curtain, the front curtain being coupled to the front side of the range hood by a T shaped member having opposite first and second ends, the first end of the T shaped member having a hook portion for attaching to the front side of the range hood, the second end of the T shaped member having a second horizontal row of permanent magnets oriented away from the range hood, the second horizontal row of permanent magnets configured to magnetically couple to the first horizontal row of permanent magnets to support the front curtain in an elevated position wherein the lower edge of the front curtain is magnetically coupled to the second end of the T shaped member. The front, left and right curtains of the enclosure are all configured to fully enclose the range and range hood.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
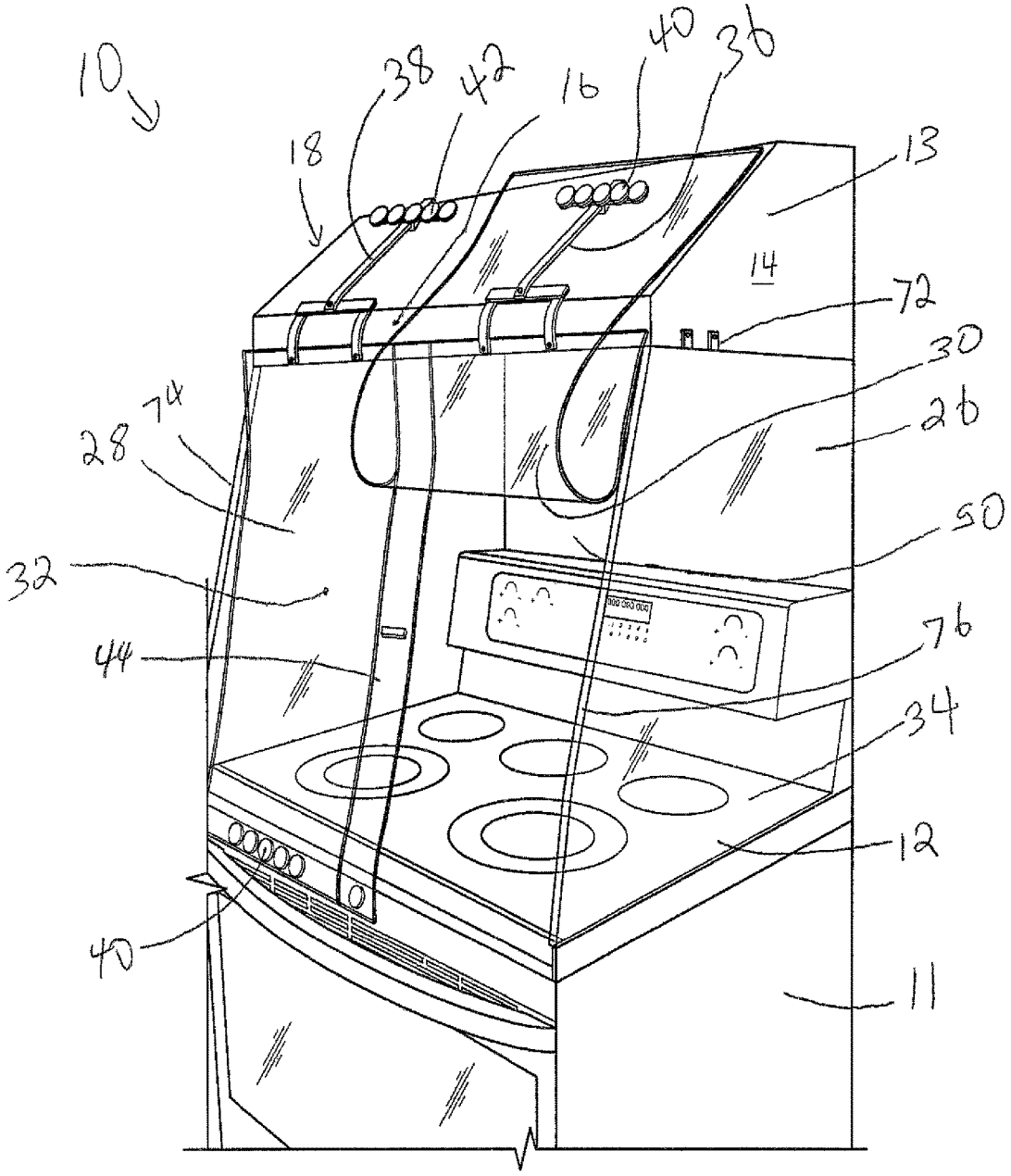
FIG. 1 is a perspective view of a range top enclosure showing one of the front curtains in an elevated position.

Referring to FIG. 1, a range top enclosure made in accordance with the present invention, shown generally as item 10, consists of a left curtain 26 depending from the left side 14 of range hood 13, a right curtain 28 depending from the right side 18 of the range hood and front curtains 30 and 32 depending from front side 16 of the range hood. Each of the curtains depend from the range hood to a portion slightly below top 34 of range top 12 of stove 11. Each of curtains 26, 28, 30 and 32 are dimensioned such that the curtains completely contain the enclosed space 50 between range hood 13 and range top 12. In particular, side curtains 26 and 28 are wider towards range top 12 and narrower towards range hood 13 so that when all of the curtains completely enclose the range top and the range hood and any smoke or fumes contained in space 50 can be vented through the range hood.

Curtains 26 and 28 are attached at their top ends to sides 14 and 18, respectively, of range hood 13 by means known generally in the art such as clamps, screws, or adhesive. Curtains 26 and 28 may be made of a clear flexible plastic, but they may also be made of a more rigid clear plastic material since they are likely to remain stationary. Curtains 30 and 32 however, must be made of a flexible clear plastic material to permit the curtains to move between a lowered position as shown by curtain 32 and a raised position as shown by curtain 30. The widths of curtains 30 and 32 are selected such that an overlap portion 44 on curtain 32 is provided where curtain 30 overlaps curtain 32 so to ensure the enclosure is more secure against leaking when both curtains are in their lowered position.

Front curtains 30 and 32 are coupled to front side 16 of range hood 13. T shaped support brackets 38 and 36 are identical. Each have a row of permanent magnets 42 which are oriented away from range hood 13. Adjacent the lower edge of each of curtains 30 and 32 is a row of permanent magnets 40. Row of permanent magnets 40 and row of permanent magnets 42 are both configured such that when the front curtains are placed in their raised position, permanent magnets 40 magnetically couple to permanent magnets 42. Preferably, magnets 40 and 42 are sufficiently strong to keep the curtains in their raised position securely. Also, when the curtains are in their lowered positions, permanent magnets 40 help to secure the bottom end of the curtains by magnetically coupling to the range 12. Suitable rare earth permanent magnets are readily available on the market which could be used.

Channels 74 and 76 are provided at the edges of front curtains 32 and 30, where the front curtains meet side curtains 28 and 26 respectively. Channels 74 and 76 are elongated plastic extrusions which are configured so that the outer edges of curtains 32 and 30 seal against channels 74 and 76, respectively, when the front curtains are lowered to ensure a relatively tight seal between the front curtains and the side curtains.

Side curtains 28 and 26 are suspended from the range hood by means of clamps 72. Clamps 72 are more particularly described below. Also, side curtains 26 and 28 and front curtains 30 and 32 are preferably made of a PVC plastic certified to handle up to 168° F. Suitable PVC plastic is generally available in the market.

Figure 2:
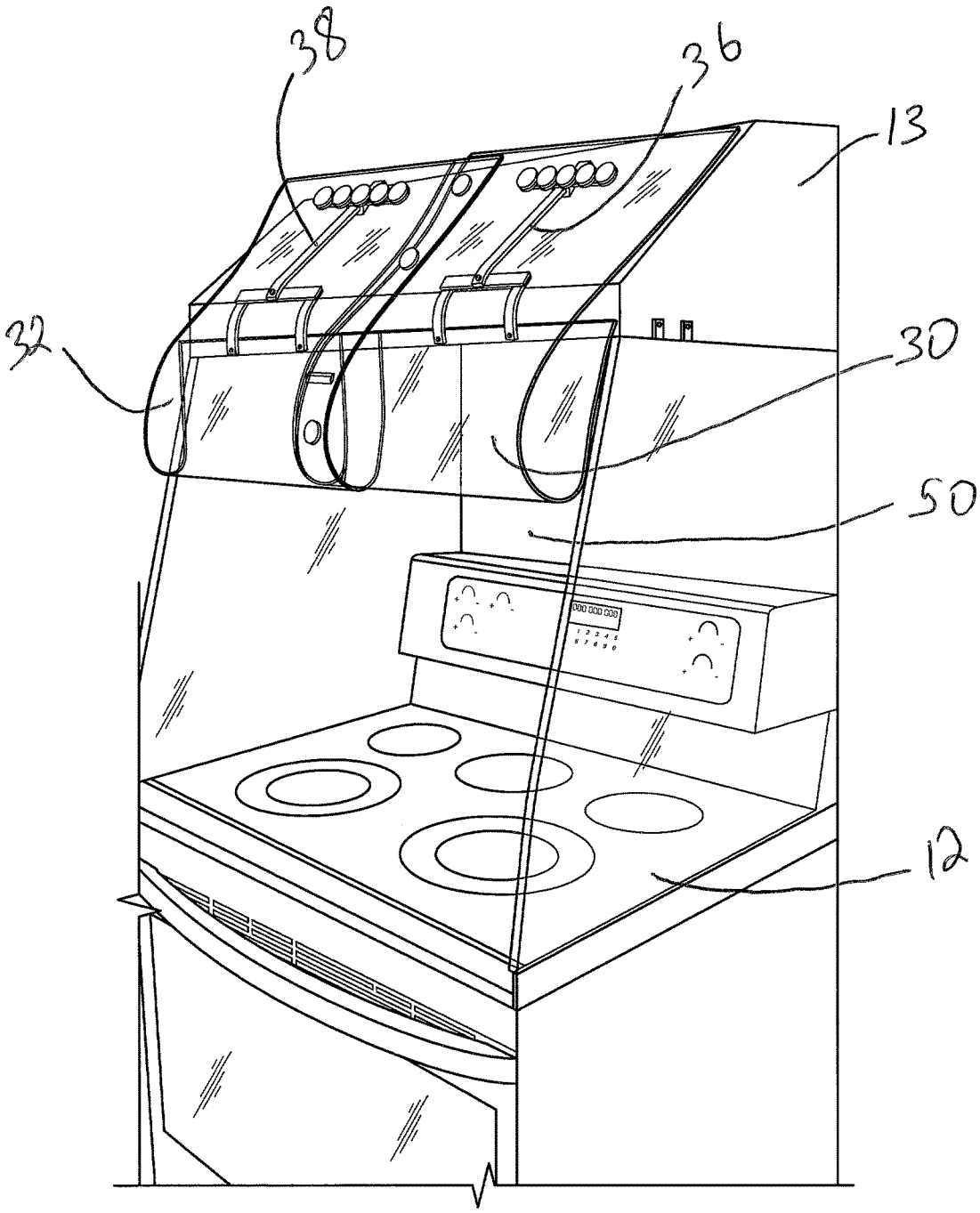
FIG. 2 is perspective view of the range top enclosure shown in FIG. 1 showing both front curtains in their elevated positions.

Referring now to FIG. 2, both curtains 30 and 32 can be placed in their elevated positions, thereby allowing the user unrestricted access to stove top 12 and space 50 between range top 12 and range hood 13. In this orientation, the user can access the range controls, access pots and pans on the range top. The magnetic supporting mechanism of T support brackets 36 and 38 keep curtains 30 and 32 secure and prevents them from accidentally falling.

Figure 3:
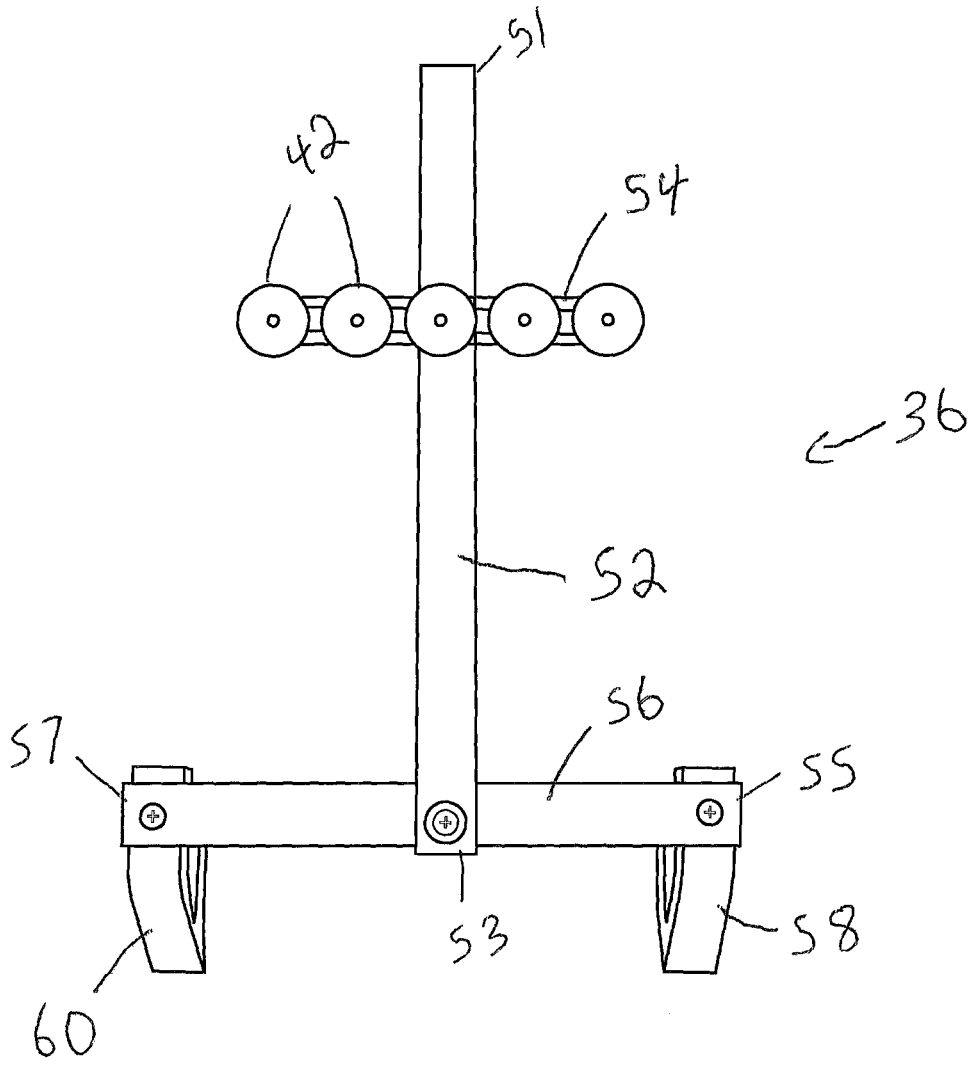
FIG. 3 is a front view of the T shaped support member portion of the range top enclose shown in FIG. 1.
Figure 4:
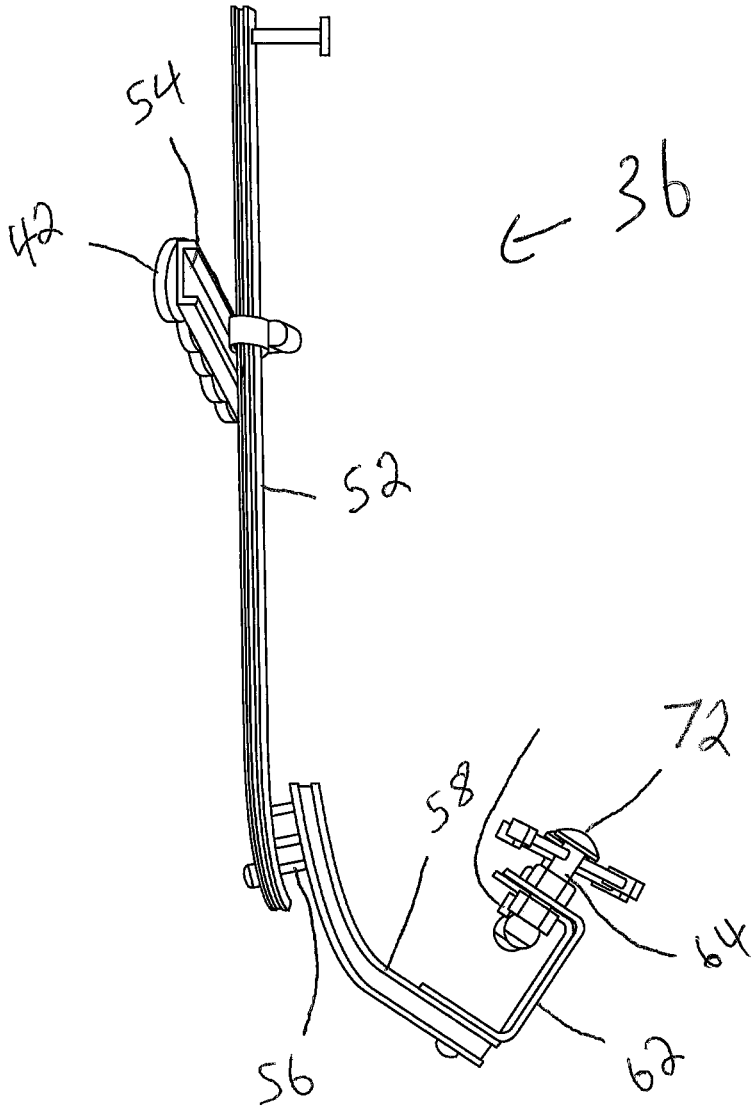
FIG. 4 is a side view of the T shaped support member shown in FIG. 3.

Referring now to FIG. 3, T shaped support member 36 will now be discussed in greater detail. It will be appreciated that both of the T shaped support members are identical. T shaped support member includes an elongated strut 52 having opposite ends 51 and 53. An upper transverse member 54 is secured to strut 52 towards end 51 and a lower transverse member 56 is secured at end 53. Transverse members 54 and 56 are secured to strut 52 by means known generally in the art, but preferably by a means which permits the transverse member 54 to selectively slide along strut 52 to permit the transverse member to be positioned along the strut and locked into place. This feature permits the front curtains level to be adjusted as desired. Transverse member 56 has opposite ends 55 and hooks 58 and 60 are positioned thereon, respectively. Magnets 42 are mounted along transverse member 54 on the side of strut 52 opposite hooks 58 and 60. As best seen in FIG. 4, clamps 72 are formed on the ends of each of the hooks. Essentially, each clamp 72 consists of a C shaped bracket 62 and a camp mechanism 64. Clamp 72 consists of a heavy duty elongated screw bolt with a handle at one end. Turning the handle at the end of the screw bolt causes the screw bolt to move relative to the rest of the C shaped bracket, enabling the user to selectively tighten or loosen the clamp. As mentioned above, clamps 72 are also used to clamp the side curtains to the range hood (see FIG. 1). When attaching T support 36 to the range hood 13 (see FIG. 1) the clamp mechanism 64 of clamps 72 can be engaged to trap an edge of the front portion of the range hood thereby holding T support flu lily to the range hood. The handle on clamps 72 make it easy to attach the clamp without additional tools simply by turning the handle thereby causing the screw bolt in the clamp to tighten or loosen as desired. It is also apparent that when so mounted to the range hood, magnets 42, which are positioned away from the hooks, will be oriented away from the range hood. As best seen in FIG. 1, by positioning magnets 42 away from hood 13, magnets 42 can make strong direct contact with corresponding magnets 40. Preferably, the row of magnets 42 and 40 are configured so that each magnet 42 makes direct physical contact with a corresponding magnet 40.

Figure 5:
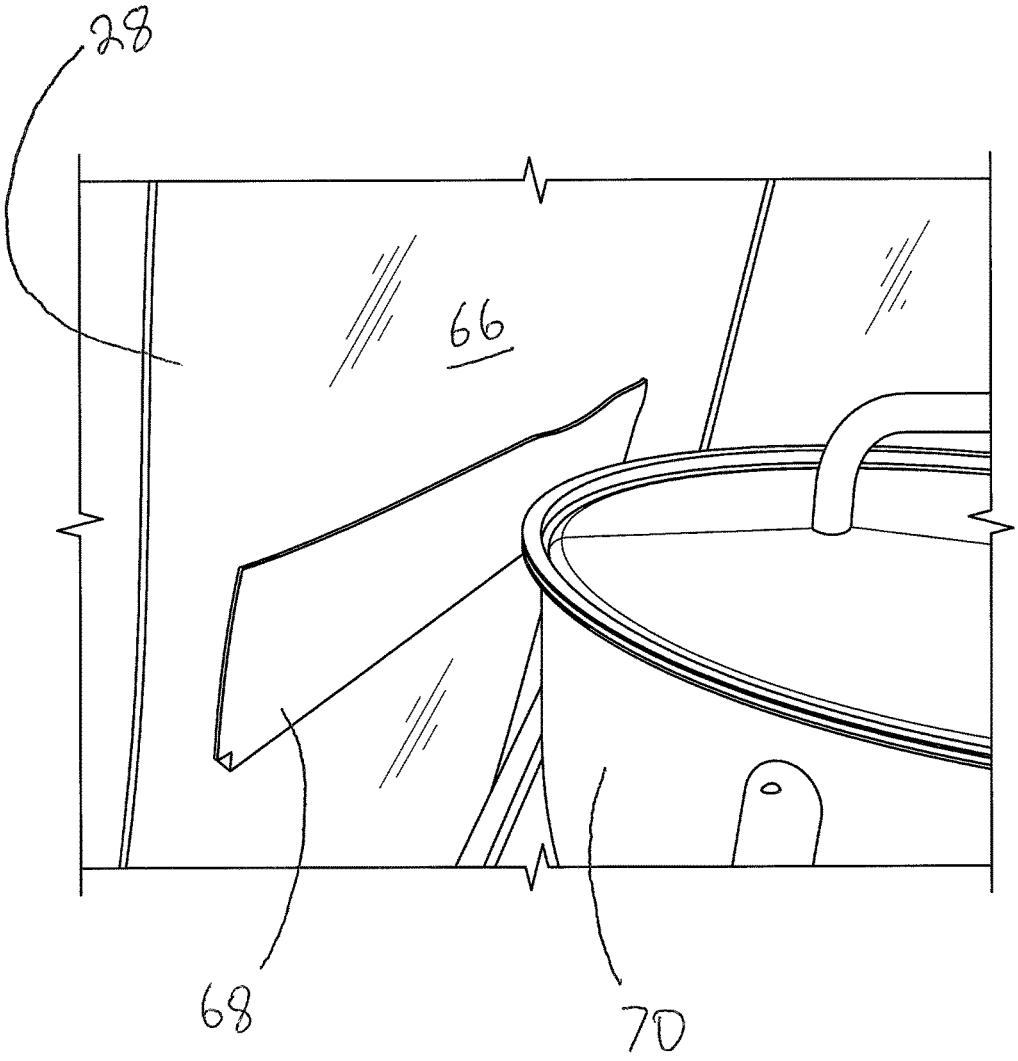
FIG. 5 is a perspective view of a portion of the front curtain showing a cooking pot contacting the heat shield portion of the front curtain.

Referring now to FIG. 5, the inside surface of the front curtains, such as front curtain 28, may be provided with a heat shield 68. Heat shield 68 preferably consists of a thick foil of reflective metal, such as aluminum, which is adhered to surface 66 by an adhesive layer formed on the reflective metal foil. This foil can be used to prevent heat transferred from a pot 70 from damaging curtain 28. Preferably, heat shield 68 is in the form of a rectangle spanning part of the width of curtain 28; however, other orientations may be used depending on the needs of the user. Indeed, heat shield 68 may be a separate item which the user can apply to the inside surface of curtain 28 as the need arises.

The present invention has several advantageous features. Firstly, the T support members make it very easy and quick to mount the front curtains to the range hood. Also, the T supports make it possible to position the rows of permanent magnets in an ideal location for making a strong magnetic coupling to the magnets positioned along the bottom of the front curtains. The T shaped members also allow for flexibility in attachment because the clamp and hook mechanism used in the T shaped members allow attachment to a variety of different sized and shapes of range hoods. The T shaped members are also easily dismounted by simply engaging the clamp mechanisms to permit ease of cleaning.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A removable enclosure for a range having opposite right and left sides, a front side and a back side, the range being positioned directly below a range hood having opposite right and left sides, a front side and a back side, the removable enclosure comprising:

a. Opposite right and left curtains depending from the right and left sides of the range hood, the right curtain extending downward to a point just below the right side of the range, the left curtain extending downward to a point just below the left side of the range;

b. A front curtain depending from the front side of the range hood and extending downward to a point just below the front side of the range, a first horizontal row of permanent magnets formed as a lower edge of the front curtain, the front curtain being coupled to the front side of the range hood by a T shaped member having opposite first and second ends, the first end of the T shaped member having a hook portion for attaching to the front side of the range hood, the second end of the T shaped member having a second horizontal row of permanent magnets oriented away from the range hood, the second horizontal row of permanent magnets configured to magnetically couple to the first horizontal row of permanent magnets to support the front curtain in an elevated position wherein the lower edge of the front curtain is magnetically coupled to the second end of the T shaped member, and c. The front, left and right curtains are configured to fully enclose the region between the range and range hood when depending downward from the range hood.

2. The removable enclosure of claim 1 wherein the T shaped member comprises a strut having opposite first and second ends, a lower transverse member extending perpendicularly from the first end of the strut and an upper transverse member extending from the second end of the strut, a pair of hooks formed on the lower transverse member, an adjustable clamp formed on an end of each hook opposite the lower transverse member, the clamp configured to clamp the front side of the rang hood between the clamp and the lower transverse member, the second row of permanent magnets positioned along the upper transverse member.

3. The removable enclosure of claim 2 wherein each of the adjustable clamps comprises a C shaped bracket having an elongated screw bolt threaded thereon, a handle formed at one end of the elongated screw bolt, the screw bolt being moved relative to the C shaped bracket by turning the handle so as to loosen or tighten the adjustable clamp as desired.

4. The removable enclosure of claim 1 wherein the front curtain comprises two separate curtains, namely a right front curtain and a left front curtain, the right and left front curtains configured such that they partially overlap.

5. The removable enclosure of claim 1 wherein the front curtain further comprises a reflective heat shield adhered to an inside surface of the front curtain, the heat shield comprising a piece of adhesive backed metallic foil.

* * * * *